United States Patent [19]

Osborn, III

[11] 4,441,962

[45] Apr. 10, 1984

[54] SOFT, ABSORBENT TISSUE PAPER

[75] Inventor: Thomas W. Osborn, III, Cincinnati, Ohio

[73] Assignee: The Procter & Gamble Company, Cincinnati, Ohio

[21] Appl. No.: 403,700

[22] Filed: Jul. 30, 1982

Related U.S. Application Data

[63] Continuation of Ser. No. 197,291, Oct. 15, 1980, abandoned.

[51] Int. Cl.[3] ..... D21H 3/12; D21H 5/24

[52] U.S. Cl. ..... 162/111; 162/112; 162/113; 162/158; 162/179

[58] Field of Search ..... 162/111, 112, 158, 179, 162/113; 252/351, 357; 428/154

[56] References Cited

U.S. PATENT DOCUMENTS

| | | | |
|---|---|---|---|
| Re. 26,939 | 8/1970 | Hervey et al. | 128/284 |
| 2,683,087 | 7/1954 | Reynolds | 162/158 |
| 3,554,862 | 1/1971 | Hervey et al. | 162/158 |
| 3,554,863 | 1/1971 | Hervey et al. | 162/158 |
| 3,677,886 | 7/1972 | Forssblad et al. | 162/158 |
| 3,821,068 | 6/1974 | Shaw | 162/111 |
| 4,144,122 | 3/1979 | Emanuelsson | 162/158 |
| 4,158,594 | 6/1979 | Becker et al. | 162/112 |
| 4,208,459 | 6/1980 | Becker et al. | 162/111 |
| 4,303,471 | 12/1981 | Laursen | 162/158 |

FOREIGN PATENT DOCUMENTS 2254120 5/1974 Fed. Rep. of Germany .

OTHER PUBLICATIONS

"Arquad Quarternary Ammonium Salts", Product Data Bulletin of Armak Co. (1972).

"Quaker 2003", Tech. Data, Quaker Chem. Corp.

*Primary Examiner*—Peter Chin

*Attorney, Agent, or Firm*—Monte D. Witte; Fredrick H. Braun; Richard C. Witte

[57] ABSTRACT

Tissue paper webs useful in the manufacture of soft, absorbent products such as paper towels, and processes for making the webs. The process comprises the steps of forming an aqueous papermaking furnish from paper pulp, at least one specified quaternary ammonium compound and at least one specified nonionic surfactant. The quaternary ammonium compounds are trimethylalkyl, trimethylalkylene, methylpolyoxyethylene alkyl and methylpolyoxyethylene alkylene quaternary ammonium compounds. The nonionic surfactants are ethylene oxide adducts of fatty alcohols and fatty acids. The second and third steps in the basic process are the deposition of the papermaking furnish onto a foraminous surface such as a Fordrinier wire and removal of the water from the deposited furnish. An alternate process involves the use of the furnish containing the quaternary ammonium compounds and the nonionic surfactants in a papermaking process which will produce a pattern densified fibrous web having a relatively high bulk field of relatively low fiber density in a patterned array of spaced zones of relatively high fiber density.

18 Claims, No Drawings

SOFT, ABSORBENT TISSUE PAPER

This is a continuation of application Ser. No. 197,291, filed Oct. 15, 1980 now abandoned.

BACKGROUND OF THE INVENTION

1. Field of the Invention

This invention relates to tissue paper webs. More particularly, it relates to soft, absorbent tissue paper webs which can be used in toweling, sanitary tissue, and facial tissue products.

2. Background Art

Paper webs or sheets, sometimes called tissue or paper tissue webs or sheets, find extensive use in modern society. Such items as paper towels, facial tissues, and sanitary (or toilet) tissues are staple items of commerce. It has long been recognized that two important physical attibutes of these products are their softness and their absorbency, particularly their absorbency for aqueous systems. Research and development efforts have been directed to the improvement of either one of these attributes without deleteriously affecting the other as well as to the improvement of both attributes simultaneously.

Softness is the tactile sensation perceived by the consumer as he holds a particular product, rubs it across his skin, or crumples it within his hand. This tactile sensation is a combination of several physical properties. One of the more important physical properties related to softness is generally considered by those skilled in the art to be the stiffness of the sheet of paper from which the product is made.

Absorbency is the measure of the ability of a product, and of the paper tissue webs from which the product may be made, to absorb quantities of liquid, particularly aqueous solutions or dispersions. Overall absorbency as perceived by the human consumer is generally considered to be a combination of the total quantity of liquid a given mass of tissue paper will absorb at saturation as well as the rate at which the mass absorbs the liquid.

Shaw, in U.S. Pat. No. 3,821,068, issued June 28, 1974, teaches that chemical debonders can be used to reduce the stiffness, and thus enhance the softness, of a tissue paper web. Becker et al., in U.S. Pat. No. 4,158,494, issued June 19, 1979, have taught that the strength of a web of tissue paper which has been softened by the addition of chemical debonding agents (which, by their very nature, serve to weaken interfiber bonds within the web) can be enhanced by adhering, during processing, one surface of the web to a creping surface in a fine pattern arrangement by a bonding material, such as an acrylic latex rubber emulsion, a water soluble resin, or another elastermeric bonding material, adhered to one surface of the web and to the creping surface in the fine pattern arrangement, and creping the web from the creping surface to form a sheet material.

Chemical debonding agents have been disclosed in various references such as U.S. Pat. No. 3,554,862, issued to Hervey et al. on Jan. 12, 1971. These materials include quaternary ammonium salts such as trimethylcocoammonium chloride, trimethyloleylammonium chloride, dimethyldi(hydrogenated-tallow)ammonium chloride and trimethylstearylammonium chloride.

The addition of debonding agents to tissue paper webs, while enhancing the softness of the webs, has been shown to decrease the absorbency of the webs. Emanuelsson et al., in U.S. Pat. No. 4,144,122, issued Mar. 13, 1979, who teach the use of complex quaternary ammonium compounds such as bis(alkoxy-(2-hydroxy)-propylene) quaternary ammonium chlorides to soften webs, strive to overcome the absorbency decrease problem with the use of nonionic surfactants such as ethylene oxide and propylene oxide adducts of fatty alcohols.

Armak Company, of Chicago, Ill., in their bulletin 76-17 (1977) have taught that the use of dimethyldi(hydrogenated-tallow)ammonium chloride in combination with fatty acid esters of polyoxyethylene glycols may impart both softening and absorbency to tissue paper webs.

DISCLOSURE OF THE INVENTION

Summary of the Invention

The present invention is a process for providing tissue paper webs having improved softness and absorbency and of the webs so produced. Briefly, the process comprises the steps of forming a papermaking furnish and making a tissue paper web from that furnish. The papermaking furnish comprises an aqueous slurry of papermaking fibers and at least one of several specified quaternary ammonium compounds and at least one of several specified nonionic surfactants.

The quaternary ammonium compounds, which are sometimes referred to as salts, include trimethylalkyl ammonium halides, trimethylalkylene ammonium halides, methylpolyoxyethylene alkyl ammonium halides, and methylpolyoxyethylene alkylene ammonium halides wherein the alkyl and alkylene radicals have from about 12 to about 18 carbon atoms and can be derived from coconut oil and tallow. The nonionic surfactants useful in this invention include ethoxylated fatty alcohols and fatty acids.

The soft, absorbent webs of this invention comprise paper pulp, quaternary ammonium compounds as described above, and nonionic surfactants as described above.

Accordingly, it is an object of this invention to provide a process for making soft, absorbent tissue paper webs.

It is a further object of this invention to provide soft, absorbent tissue paper sheets.

It is a still further object of this invention to provide soft, absorbent paper towel products.

These and other objects will become readily apparent from a reading of the following detailed description of the invention.

DETAILED DESCRIPTION OF THE INVENTION

While this specification concludes with claims particularly pointing out and distinctly claiming the subject matter regarded as the invention, it is believed that the invention can be better understood from a reading of the following detailed description and of the appended examples.

As used herein, the terms tissue paper web, paper web, web, and paper sheet all refer to sheets of paper made by a process comprising the steps of forming an aqueous papermaking furnish, depositing this furnish on a foraminous surface, such as a Fourdrinier wire, and removing the water from the furnish as by gravity or vacuum-assisted drainage, with or without pressing, and by evaporation.

As used herein, an aqueous papermaking furnish is an aqueous slurry of papermaking fibers and the chemicals described hereinafter.

The first step in the process of this invention is the forming of an aqueous papermaking furnish. This furnish comprises papermaking fibers, (hereinafter sometimes referred to as paper pulp) at least one quaternary ammonium compound as hereinafter described, and at least one nonionic surfactant as hereinafter described.

It is anticipated that wood pulp in all its varieties will normally comprise the papermaking fibers used in this invention. However, other cellulosic fibrous pulps, such as cotton liners, bagasse, rayon, etc., can be used and none are disclaimed. Wood pulps useful herein include both sulphite and sulfate pulps as well as mechanical and thermomechanical pulps all well known to those skilled in the art. Pulps derived from both desiduous and coniferous trees can be used. Preferably, the papermaking fibers used in this invention comprise Kraft pulp derived from northern softwoods.

The quaternary ammonium compounds used in this invention are selected from the group consisting of quaternary ammonium compounds having the structure,

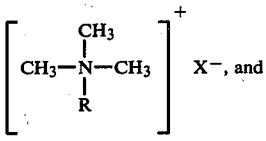

$X^-$, and quaternary ammonium compounds having the structure,

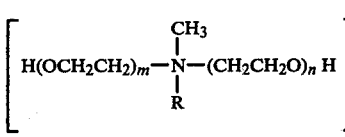

$X^-$.

In the two structures noted above R is an aliphatic hydrocarbon radical selected from the group consisting of alkyl having from about 12 to about 18 carbon atoms, alkylene having from about 12 to about 18 carbon atoms, coconut and tallow; m and n are both itegers each having a value of at least 1; the sum of m and n is from about 2 to about 15; and X is a halogen.

As used above, "coconut" refers to the alkyl and alkylene moieties derived from coconut oil. It is recognized that coconut oil is a naturally occuring mixture having, as do all naturally occuring materials, a range of compositions. Coconut oil contains primarily fatty acids (from which the alkyl and alkylene moieties of the quaternary ammonium salts are derived) having from 12 to 16 carbon atoms, although fatty acids having fewer and more carbon atoms are also present. Swern, Ed. in *Bailey's Industrial Oil And Fat Products,* Third Edition, John Wiley and Sons (New York 1964) in Table 6.5, suggests that coconut oil typically has from about 65 to 82% by weight of its fatty acids in the 12 to 16 carbon atoms range with about 8% of the total fatty acid content being present as unsaturated molecules. The principle unsaturated fatty acid in coconut oil is oleic acid. Synthetic as well as naturally occuring "coconut" mixtures fall within the scope of this invention.

Tallow, as is coconut, is a naturally occuring material having a variable composition. Table 6.13 in the above-identified reference edited by Swern indicates that typically 78% or more of the fatty acids of tallow contain 16 or 18 carbon atoms. Typically, half of the fatty acids present in tallow are unsaturated, primarily in the form of oleic acid. Synthetic as well as natural "tallows" fall within the scope of the present invention. As used herein, "tallow" specifically excludes those tallows which have been hydrogenated to significantly reduce the level of unsaturation therein.

Preferably, the alkyl and alkylene radicals, except as noted below, have from about 16 to about 18 carbon atoms. Alkylenes are generally preferred to alkyls. Coconut is more preferred than the alkyl and alkylene radicals noted above.

In the case of the methylpolyoxyethylene quaternary ammonium compounds, the sum of m and n is preferably about 2.

Any of the halide salts can be used in the present invention. Typically, and preferably, the chloride is used. Hereinafter the quaternary ammonium compound will frequently be referred to as the chloride for convenience even though the other halide salts are expressly not disclaimed.

Specific examples of quaternary ammonium salts useful in this invention include trimethyloctadecylammonium chloride, trimethylcocoammonium chloride, trimethyltallowammonium chloride, trimethylolelylammonium chloride, methylbis(2-hydroxyethyl)cocoammonium chloride, methylbis(2-hydroxyethyl)oleylammonium chloride, methylbis(2-hydroxyethyl)octadecylammoium chloride, methylbis(2-hydroxyethyl)-tallowammoium chloride, methylpolyoxyethylene(15-)cocoammonium chloride, and methylpolyoxyethylene(15)olylammonium chloride.

The most preferred quaternary ammonium compound is methylbis(2-hydroxyethyl)cocoammonium chloride.

The quaternary ammonium salt is added to the papermaking furnish at a level of from about 0.5 to about 5.0 grams per kilogram of bone dry papermaking fiber. Preferably, it is added at from about 1.0 to about 2.5 grams per kilogram.

These quaternary ammonium compounds can be prepared by any of the means well known to those skilled in the art.

Nonionic surfactants useful in the present invention include the ether and ester adducts of ethylene oxide and fatty chemicals. That is to say, the nonionic surfactants useful herein can be described as the ethylene oxide adducts of, respectively, fatty alcohols and fatty acids. The fatty moiety of the nonionic surfactants comprises from about 12 to about 18 carbon atoms. The ethylene oxide moiety of the nonionic surfactant comprises from about 2 to about 12 moles ethylene oxide, preferably from about 2 to about 9 moles of ethylene oxide. Preferably, the fatty moiety is unsaturated. Specific examples of nonionic surfactants useful in the present invention include polyoxyethylene(2)oleyl ether and polyoxyethylene(9)oleyl ester. The former is known in CFTA nomenclature as Oleth-2, the latter as PEG-9 oleate.

Diesters, such as PEG-4 dilaurate (two moles of lauric acid adducted with 4 moles of ethylene oxide), are also useful in the present invention.

These nonionic surfactants can be prepared by any of the means well known to those skilled in the art.

The nonionic surfactant is present in the papermaking furnish at a level of from about 0.5 to about 5.0 grams per kilogram bone dry papermaking fiber, preferably from about 1.0 to about 2.5 grams per kilogram.

Preferably, either the quaternary ammonium compound or the nonionic surfactant contains an unsaturated (alkylene) moiety. More preferably, both contain such an unsaturated (alkylene) moiety.

Other chemicals commonly used in papermaking can be added to the papermaking furnish so long as they do not significantly and adversely affect the softening and absorbency enhancing actions of the two required chemicals.

The papermaking furnish can be readily formed or prepared by mixing techniques and equipment well known to those skilled in the papermaking art.

The second step in the process of this invention is the depositing of the papermaking furnish on a foraminous surface and the third is the removing of the water from the furnish so deposited. Techniques and equipment which can be used to accomplish these two processing steps will be readily apparent to those skilled in the papermaking art.

As noted above, the addition of debonding agents, such as the quaternary ammonium compound/nonionic surfactant systems described herein, to a paper web enhances the softness of the web, but, at the same time, decrease the strength (such as the tensile strength) of the web because they, by their very nature, weaken interfiber bonds within the web. In order to have a tissue paper web of such a strength as to be useful in a wider variety of soft, absorbent products, it is sometimes necessary that the strength of the web be enhanced in some manner. It has been surprisingly discovered that the following described papermaking process is particularly useful in the practice of the present invention.

The tissue paper web in which the present invention finds particularly utility is a pattern densified fibrous web having a relatively high bulk field of relatively low fiber density and a patterned array of spaced zones of relatively high fiber density. At least a substantial proportion of the relatively high density spaced zones are at least partially impregnated with binder material. The high bulk field is preferably substantially uncompacted and devoid of binder material.

The pattern densified fibrous web is prepared by a process comprising several steps. The first step is the supplying of a papermaking furnish comprising papermaking fibers and at least one quaternary ammonium compound and at least one nonionic surfactant as hereinbefore described.

The second step comprises the forming of a patterned densified embryonic web having an array of discrete high density zones disposed in a predetermined pattern.

The third step comprises supporting the embryonic web on a corresponding array of spaced supports so that at least each of a predetermined sub-array of the high density zones is juxtaposed one of a corresponding sub-array of the supports.

The fourth step is impregnating, at least partially, at least a substantial proportion of the supported predetermined sub-array of high density zones with a binder material by biasing the predetermined sub-array of supports toward a contacting type impregnating means with the sub-array of the high density zones disposed between the sub-array of the supports and the impregnating means.

The array of spaced supports can be the knuckles of an endless imprinting carrier fabric and the sub-array of such supports may be only the top-surface-plane knuckles of the fabric in fabrics having both top-surface-plane knuckles and sub-top-surface knuckles. In fabrics having no sub-top-surface knuckles, the sub-array of supports would, in fact, be the array of supports.

For maximum strength, all of the high density zones should be impregnated with binder material. Only a portion of the high density zones need be partially impregnated in webs wherein partial impregnation provides sufficient strength for their intended use. Impregnating means such as a full field gravure applicator can be used to impregnate the high density zones of the webs biased against it whereas less-than-full-field gravure applicators can be used to only partially impregnate all or some of the high density zones of the web, or wholly impregnate only some of the high density zones.

Further, the method can comprise an additional step of subjecting the impregnated zones to further mechanical pressure or compaction after they are impregnated to increase the binder penetration and interfiber bonding therein.

Still further, the process can include an optional drying step immediately preceding the impregnating step wherein the embryonic web is dried in the absence of substantial mechanical compression to an average fiber consistency of from about 30 to about 95% by weight.

The web is normally dried after the impregnation step.

Preferably, the web is also creped, calendered and reeled after being impregnated and dried to further increase its stretch, bulk and softness, and to control its caliber.

Preferably, this optional drying step is sufficiently asymmetrical to dry the unsupported portions of the embryonic web substantially more than the high density portions.

Binder materials useful in this process include all of those commonly used in papermaking, such as the latex type binder emulsions. Specific examples of binder include the self-crosslinking acrylic latex emulsion sold by The Rohm & Haas Co., Philadelphia, Pa., under the designation TR520. (When this particular binder is used, the binder system further comprises about 0.5% by weight of latex solids ammonium nitrate as a latent acid catalyst, about 1% nonionic surfactant such as Pluronic L-92 sold by BASF Wyandotte Corporation of Wyandotte, Mich., and sufficient ammonium hydroxide to adjust the pH of the binder solution to about 5.2.)

The amount of binder impregnated into the sheet is preferably from about 3% to about 5% by weight of bone dry paper pulp although it is not intended to limit the present invention to this range of binder level.

It is to be emphasized that in this embodiment of the invention, the soft absorbent tissue paper web comprises a multiplicity of relatively high density zones impregnated with a binder material interposed between and among a plurality of usually vaulted or arcuate shaped low density span portions which are substantially uncompacted and devoid of binder material. Both parts of the finished web comprise at least one quaternary ammonium compound and at least one nonionic surfactant used in this invention.

The tissue paper web of this invention can be used in any application where soft, absorbent tissue paper webs are required. One particularly advantageous use of the tissue paper web of this invention is in paper towel products. For example, two tissue paper webs of this invention can be embossed and adhesively secured together in face to face relation as taught by U.S. Pat. No. 3,414,459, which issued to Wells on Dec. 3, 1968 and which is incorporated herein by reference, to form 2-ply paper towels.

EXAMPLE I

A papermaking furnish comprising unbeaten northern softwood Kraft pulp, quaternary ammonium compound, and nonionic surfactant was formed according to the teachings of this invention. First, a 5% by weight aqueous slurry of fibers was formed in a conventional repulper. Methylbis(2-hydroxyethyl)cocoammonium chloride (as sold under the tradename "Ethoquad C/12" by Armak Company of Chicago, Ill.) was added to the pulp slurry at the rate of 2 grams of quaternary ammonium compound per kilogram of bone dry fiber. Oleth-2 (as sold under the tradename "Brij 93" by I.C.I. Americas Inc. of Wilmington, Del.), dissolved in isopropyl alcohol, was added to the fiber slurry at the rate of 2 grams of nonionic surfactant per kilogram of bone dry fiber.

The thus formed papermaking furnish was made into a tissue paper web on a pilot scale papermaking machine.

The above formed papermaking furnish was diluted with water so as to form a slurry containing approximately 0.12% by weight fiber. This diluted papermaking furnish was deposited onto a Fourdrinier wire of a 4-shed satin weave having about 31×24, machine direction (MD) by cross machine direction (CD) filament mesh count per centimeter to form an embryonic web. Water was progressively removed from the deposited furnish while the embryonic web was being carried through the machine first on the hereinbefore described Fourdrinier wire and then on an intermediate carrier wire having the same design as the Fourdrinier wire until the fiber consistency of the embryonic web was about 22% by weight. The web was then transferred to an imprinting fabric which had a 5-shed satin weave of 14×13, MD by CD, filaments per centimeter such as described in U.S. Pat. No. 4,191,609 issued to Paul D. Trokhan on Mar. 4, 1980. Further dewatering was accomplished by vacuum assisted drainage until the web had a fiber consistency of about 32%. As a result of the transfer from the intermediate carrier wire to the imprinting fabric and the vacuum assisted dewatering, the web became patterned densified. The discrete spaced high density zones were justaposed the top-surface-plane knuckles of the imprinting fabric and the relatively low density spans between those knuckles. Vacuum induced differential fluid pressure caused the unsupported portions of the web to be displaced into the interfilimentary voids of the imprinting fabric. The now patterned densified web was predried by air blow-through to a fiber consistency of about 78% by weight.

The web, while still disposed on the imprinting fabric, was carried forward through a full field pattern, pressure biased gravure impregnating means in such a manner that the high density zones of the web were pressed against the gravure cylinder and thereby impregnated with binder material. The low density span zones were not so impregnated by virtue of having been sufficiently displaced into the interfilimentary spaces of the imprinting fabric and the absence of mechanical pressure urging these low density span portions against the rotagravure cylinder of the gravure impregnating means.

The binder used to impregnate the high density zones was the hereinbefore described TR-520 emulsion system containing Pluronic L92 and ammonium nitrate. In addition, trace levels of commercial defoamers Foammaster 160-L as made by the Diamond Shamrock Corp. of Cleveland, Ohio, and Colloid 694 as made by Colloids Inc. of Newark, N.J., were added to the binder system. Binder was added to the web at a level of approximately 3% by weight of fiber.

Following impregnation, the web was adhered to the surface of a Yankee dryer with Gelvatol 20–90, a polyvinyl alcohol/acetate creping adhesive manufactured by Monsanto Co. of St. Louis, Mo. The web was creped from the surface of the Yankee dryer in a conventional manner by a doctor blade and was formed into rolls by reeling at 80% of the Yankee speed.

Two plys of the web were formed into paper towel products by laminating them together using polyvinyl alcohol as the adhesive and the technique described in the hereinbefore incorporated patent to Wells. The laminate was passed through a forced air oven at 232° C. to cure the later binder.

Conventional control paper towels were made by the foregoing process except that the papermaking furnish did not contain the quaternary ammonium compound or the nonionic surfactant and the imprinting fabric had a 3-shed weave of 12×10, MD by CD, filaments per centimeter. The paper towels of this invention made from the webs of this invention as made by the process of this invention, when compared to the control paper towels, were found to be significantly more absorbent by objective physical testing and significantly softer by human panel testing.

EXAMPLE II

Example I was repeated except that the quaternary ammonium compound used was methylbis(2-hydroxyethyl)oleylammonium chloride as sold under the tradename "Ethoquad 0/12" by Armak Co. and the web was dried to 96% consistency before impregnation with binder. The resulting paper towels were slightly less absorbent than those prepared in Example I, allbeit still more absorbent than the control paper towels, and were softer than the towels of Example I.

EXAMPLE III

Paper towels of this invention are prepared by the process of Example I, except that trimethylhexadecylammonium chloride (as sold under the tradename "Adogen 415" by Sherex Chemical Co. of Columbus, Ohio) is used as the quaternary ammonium compound and PEG-4 dilaurate is used as the nonionic surfactant. The resulting paper towels are soft and absorbent.

What is claimed is:

1. A process for making a soft, absorbent tissue paper web comprising the steps of forming an aqueous papermaking furnish, depositing said furnish on a foraminous surface, removing the water from said furnish, and enhancing the strength of the web so formed wherein said aqueous papermaking furnish comprises:

(a) papermaking fibers;

(b) at least one quaternary ammonium compound having the structure

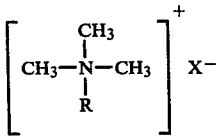

wherein R is an aliphatic hydrocarbon radical selected from the group consisting of alkyl radicals having from about 12 to about 18 carbon atoms, alkylene radicals having from about 12 to about 18 carbon atoms, coconut, and tallow, and X is halogen;

(c) at least one nonionic surfactant selected from the group consisting of (1) ethylene oxide adducts of fatty alcohols; and (2) ethylene oxide adducts of fatty acids wherein said fatty alcohols and fatty acids each have from about 12 to about 18 carbon atoms and wherein said adducts contain from about 2 to about 12 moles of ethylene oxide;

wherein said quaternary ammonium compound is present at from about 0.5 to about 5.0 grams per kilogram of paper making fiber and said nonionic surfactant is present at from about 0.5 to about 5.0 grams per kilogram of papermaking fiber.

2. The process of claim 1 wherein R is unsaturated.

3. The process of claim 1 wherein the fatty moiety is said nonionic surfactant is unsaturated.

4. The process of claim 1 wherein R is unsaturated and the fatty moiety of said nonionic surfactant is unsaturated.

5. The process of claims 1, 2, 3, or 4 wherein R is coconut.

6. The process of claim 5 wherein said nonionic surfactant is the adduct of oleyl alcohol with 2 moles of ethylene oxide.

7. A process for making a soft, absorbent tissue paper web comprising the steps of (1) forming an aqueous papermaking furnish;

(2) forming from said papermaking furnish a fibrous pattern densified embryonic web having a multiplicity of discrete zones of relatively high density disposed in a predetermined pattern array;

(3) supporting said embryonic web on an array of spaced supports so that each of a predetermined sub-array of said high density zones is juxtaposed one of a predetermined sub-array of said supports;

(4) at least partially impregnating at least a substantial proportion of the supported predetermined sub-array of said high density zones with a binder by biasing said predetermined sub-array of said supports towards a contacting type impregnating means with said sub-array of said high density zones disposed between said sub-array of said supports and said impregnating means;

(5) drying said embryonic web; and (6) creping said dried web wherein said papermaking furnish is an aqueous slurry comprising:

(a) papermaking fibers;

(b) at least one quaternary ammonium compound having the structure

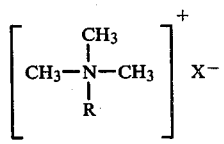

wherein R is an aliphatic hydrocarbon radical selected from the group consisting of alkyl radicals having from about 12 to about 18 carbon atoms, alkylene radicals having from about 12 to about 18 carbon atoms, coconut, and tallow, and X is halogen;

(c) at least one nonionic surfactant selected from the group consisting of (1) ethylene oxide adducts of fatty alcohols; and (2) ethylene oxide adducts of fatty acids wherein said fatty alcohols and fatty acids each have from about 12 to about 18 carbon atoms and wherein said adducts contain from about 2 to about 12 moles of ethylene oxide;

wherein said quaternary ammonium compound is present at from about 0.5 to about 5.0 grams per kilogram of papermaking fiber and said nonionic surfactant is present at from about 0.5 to about 5.0 grams per kilogram of papermaking fiber.

8. The process of claim 7 wherein R is unsaturated.

9. The process of claim 7 wherein the fatty moiety of said nonionic surfactant is unsaturated.

10. The process of claim 7 wherein R is unsaturated and the fatty moiety of said nonionic surfactant is unsaturated.

11. The process of claim 7, 8, 9, or 10 wherein R is coconut.

12. The process of claim 11 wherein said nonionic surfactant is the adduct of oleyl alcohol with 2 moles of ethylene oxide.

13. The soft, absorbent tissue paper web made by the process of claims 1, 2, 3, or 4.

14. The soft, absorbent tissue paper web made by the process of claim 5.

15. The soft, absorbent tissue paper web made by the process of claim 6.

16. The soft, absorbent tissue paper web made by the process of claims 7, 8, 9, or 10.

17. The soft, absorbent tissue paper web made by the process of claim 11.

18. The soft, absorbent tissue paper web made by the process of claim 12.

* * * * *